US008434648B2

(12) United States Patent
Marie et al.

(10) Patent No.: US 8,434,648 B2
(45) Date of Patent: May 7, 2013

(54) RING FOR A FLUID DISPENSER VALVE

(75) Inventors: Christophe Marie, Caen (FR); Ian Fletcher, Leicestershire (GB)

(73) Assignee: Aptar France SAS, Le Neubourg (FR)

( * ) Notice: Subject to any disclaimer, the term of this patent is extended or adjusted under 35 U.S.C. 154(b) by 386 days.

(21) Appl. No.: 12/666,763

(22) PCT Filed: Jun. 27, 2008

(86) PCT No.: PCT/FR2008/051177

§ 371 (c)(1),
(2), (4) Date: Jul. 6, 2010

(87) PCT Pub. No.: WO2009/004270

PCT Pub. Date: Jan. 8, 2009

(65) Prior Publication Data

US 2010/0276459 A1 Nov. 4, 2010

(30) Foreign Application Priority Data

Jun. 28, 2007 (FR) ..... 07 56105

(51) Int. Cl.
*B65D 83/00* (2006.01)

(52) U.S. Cl.
USPC ..... 222/402.1; 222/402.2; 222/542

(58) Field of Classification Search ..... 222/402.1, 222/402.2, 402.22–402.25, 394, 542
See application file for complete search history.

(56) References Cited

U.S. PATENT DOCUMENTS

| | | | | |
|---|---|---|---|---|
| 3,977,576 | A * | 8/1976 | Amabili | 222/402.1 |
| 4,349,135 | A | 9/1982 | Busselet | |
| 4,867,352 | A * | 9/1989 | Meshberg | 222/402.16 |
| 4,944,433 | A * | 7/1990 | Knecht et al. | 222/402.2 |
| 5,037,012 | A * | 8/1991 | Langford | 222/402.2 |
| 5,370,862 | A * | 12/1994 | Klokkers-Bethke et al. | 424/47 |
| 5,593,069 | A * | 1/1997 | Jinks | 222/246 |
| 5,632,421 | A * | 5/1997 | Colombo | 222/402.2 |
| 5,697,532 | A * | 12/1997 | Wilde et al. | 222/402.16 |
| 6,095,182 | A * | 8/2000 | Warby | 137/375 |
| 6,640,805 | B2 * | 11/2003 | Castro et al. | 128/200.23 |
| 6,644,306 | B1 * | 11/2003 | Riebe et al. | 128/200.23 |
| 6,978,915 | B1 * | 12/2005 | Russell | 222/402.2 |
| 7,278,556 | B2 * | 10/2007 | Goujon et al. | 222/402.1 |
| 7,942,146 | B2 * | 5/2011 | Boeck | 128/200.23 |
| 2006/0273116 | A1 | 12/2006 | Burghaus et al. | |

FOREIGN PATENT DOCUMENTS

| | | | |
|---|---|---|---|
| DE | 10 2005 002444 | A1 | 7/2006 |
| EP | 1 464 408 | A2 | 10/2004 |
| FR | 1 491 146 | A | 8/1967 |
| FR | 2 450 758 | A | 10/1980 |
| FR | 2 502 592 | A | 10/1982 |
| GB | 1 219 935 | A | 1/1971 |

(Continued)

*Primary Examiner* — Frederick C. Nicolas
(74) *Attorney, Agent, or Firm* — Sughrue Mion, PLLC

(57) ABSTRACT

A ring (10) for disposing around a valve body (21) of an aerosol dispenser valve (20) that is mounted by a fastener element (50), such as a crimpable capsule, on a reservoir (1) containing fluid to be dispensed. The ring (10) includes at least an outer portion (15) and an inner portion (11, 11') that co-operates with the valve body (21). The ring (10) is made as a single piece that is substantially rigid, the outer portion (15) being adapted to co-operate in leaktight manner, by deformation of its material, with a portion of the reservoir (1) while the fastener element (50) is being assembled on the reservoir (1).

12 Claims, 2 Drawing Sheets

FOREIGN PATENT DOCUMENTS

| | | | | |
|---|---|---|---|---|
| GB | 1358498 | A | * | 7/1974 |
| GB | 2206099 | A | * | 12/1988 |
| GB | 2 344 621 | A | | 6/2000 |
| WO | 2006/038874 | A1 | | 4/2006 |

* cited by examiner

RING FOR A FLUID DISPENSER VALVE

The present invention relates to a ring for an aerosol dispenser valve.

It is known to use rings with aerosol dispenser valves, in particular metering valves that are mounted on a reservoir containing the fluid to be dispensed. In particular, such rings are used in valves that are suitable for use upsidedown, i.e. with the valve disposed below the reservoir while a dose of fluid is being expelled. Such rings generally fulfill two main functions, namely firstly ensuring that a maximum quantity of the fluid contained inside the reservoir can be dispensed, by limiting the dead volume situated below the inlet of the valve when said valve is in its upsidedown working position. Secondly, such rings also serve to limit contact between the fluid and the neck gasket that is generally disposed between the neck of the reservoir and the fastener hoop or capsule that serves to fasten the valve on the receptacle. By limiting contact between the gasket and the fluid contained in the reservoir, the risks of the fluid becoming contaminated by extractables that can be leached from said gasket are limited, and also deterioration of the gasket as a result of its contact with the fluid, in particular a propellant gas, is limited. However, even limited contact between the gasket and the fluid can produce unacceptable contamination of said fluid.

In general, the ring is assembled on the valve body by radially clamping an inner edge of the ring onto said valve body, in particular by being force-fitted. That configuration presents the drawback that when the radial clamping is too strong, it can deform the valve body over time, and in particular the inside of said body, and that can cause the valve to malfunction. Numerous valves provide a relatively narrow gap between the valve member that slides and the valve body. Radial deformation of the valve body can thus cause friction and even jamming of said valve member. In particular, when the fastener capsule is a crimpable capsule, the crimping can cause the neck of the reservoir to deform radially, thereby increasing the radial compression exerted on the ring. This increase in the radial compression transmitted to the inner edge of the ring can cause an increase in the stress exerted on the valve body, and can cause said valve body to deform. There exist rings provided with deformable tabs or walls that are adapted to compensate for the forces likely to be exerted during crimping. However, such rings are of shapes that are rather complex, and thus relatively costly to make. Other rings are fastened by force-fitting in the reservoir, thereby making assembly more complex, in particular because of manufacturing tolerances.

An object of the present invention is to provide a ring and an aerosol dispenser device including such a ring that does not have the above-mentioned drawbacks.

More particularly, an object of the present invention is to provide a ring for an aerosol dispenser device that limits excessive radial stress on the valve body, thereby limiting the risks of the valve body deforming excessively, in particular while the valve is being crimped on the reservoir.

Another object of the present invention is to provide such a ring that makes it possible to compensate for dispersion in manufacturing tolerances, without increasing radial stress on the valve body.

Another object of the present invention is to provide such a ring that maximizes the amount of the content of the reservoir that can be dispensed.

Another object of the present invention is to provide such a ring that eliminates any contact between the neck gasket and the fluid contained in the reservoir.

Another object of the present invention is to provide such a ring that is simple and inexpensive to manufacture and to assemble.

The present invention thus provides a ring for disposing around a valve body of an aerosol dispenser valve that is mounted by means of a fastener element, such as a crimpable capsule, on a reservoir containing fluid to be dispensed, said ring comprising at least an outer portion and an inner portion that co-operates with said valve body, said ring being made as a single piece that is substantially rigid, said outer portion being adapted to co-operate in leaktight manner, by deformation of its material, with a portion of the reservoir while the fastener element is being assembled on the reservoir.

Advantageously, said ring is dimensioned such that it co-operates in leaktight manner with the reservoir only after the fastener element has been assembled on the reservoir.

Advantageously, said outer portion forms a smooth surface, preferably mirror-polished, before the fastener element is assembled on the reservoir.

Advantageously, said at least one inner portion presents a small contact surface with the valve body.

Advantageously, said ring includes a radially-inner portion that co-operates with a portion of the valve body, and a second inner portion that co-operates with another portion of the valve body.

Advantageously, the ring includes only a single inner portion in contact with the valve body.

Advantageously, the top surface of the ring comes into contact with a neck gasket, and extends over the major fraction of the bottom surface of said neck gasket.

In a variant, said ring makes no contact with the neck gasket.

Advantageously, said ring is made integrally with said valve body at an inner portion of the ring that forms a connection piece.

Advantageously, while the fastener element is being assembled on the reservoir, said outer portion creeps around a portion of the reservoir, creating total sealing at this creepage.

The present invention also provides a fluid dispenser valve including a ring as described above.

The present invention also provides a fluid dispenser device including a valve as described above mounted on a reservoir.

These characteristics and advantages and others of the present invention appear more clearly from the following detailed description of several embodiments thereof, given by way of non-limiting example, and with reference to the accompanying drawings, in which.

Figure 1:
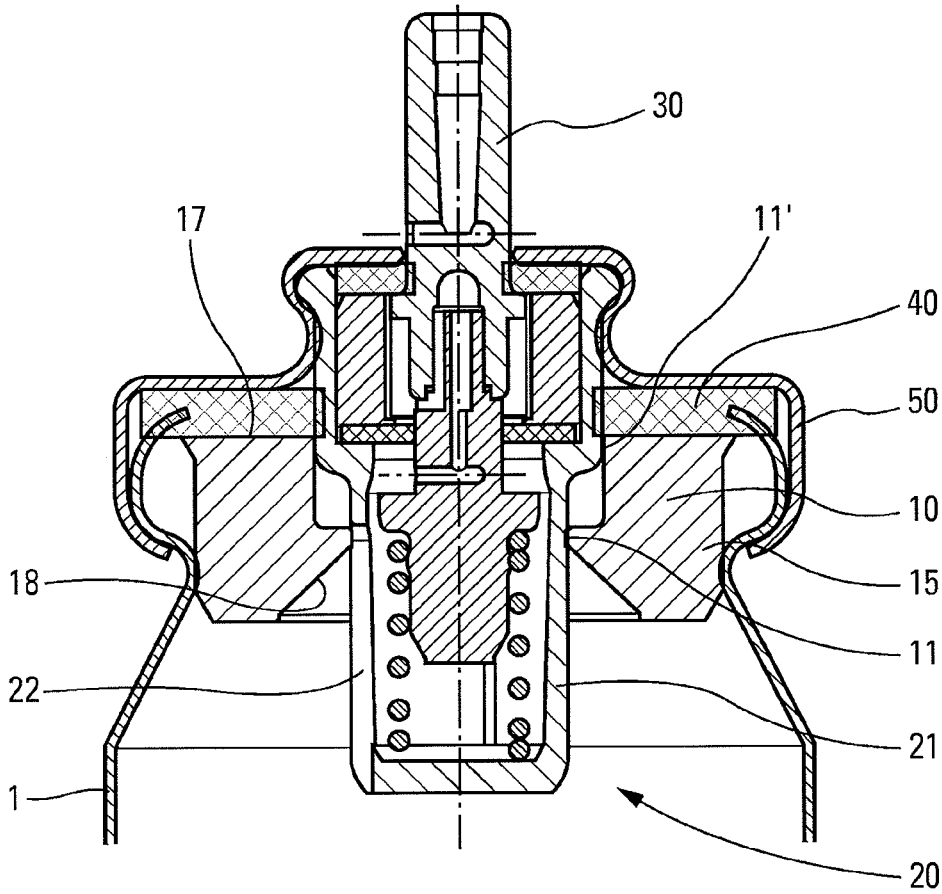
FIG. 1 is a diagrammatic section view of an aerosol dispenser device in its upright position, including a ring constituting a first embodiment of the present invention.

With reference to the figures, the aerosol device includes a reservoir 1 containing the fluid to be dispensed. The fluid can be of the pharmaceutical type, and propellant gas can be provided for dispensing the fluid through an aerosol valve 20, preferably a metering valve. The aerosol valve includes a valve body 21 in which a valve member 30 slides. The valve body 21 is assembled on the neck of the reservoir 1 by means of a fastener hoop or capsule 50, in particular of the crimpable type, with a neck gasket 40 interposed therebetween for sealing purposes. In particular, the valve shown is for being used upsidedown, i.e. while a dose is being expelled, the valve is situated below the reservoir. The valve body 21 includes one or more openings 22 making it possible to fill the valve with fluid from the reservoir. The openings are shown in the form of lateral longitudinal slots 22 that extend over a fraction of the height of the valve body 21. In a variant, one or more openings of different shapes could be provided for this purpose.

In the invention, a ring 10 is disposed around the valve body 21.

The ring 10 serves in particular to ensure that the reservoir is emptied as much as possible by minimizing the dead volume situated below the bottom edge of the opening(s) 22 of the valve body 21 when the valve is in its upsidedown working position.

The ring 10 includes at least one inner portion 11 for co-operating with the valve body 21. Preferably, the inner portion 11 is the radially-innermost portion of the ring 10. Advantageously, a second inner portion 11' is provided to co-operate with another portion of the valve body. This configuration makes it possible to distribute the radial stress exerted by the ring 10 on the valve body 21 over two fastener zones instead of one, thereby firstly limiting the radial stress exerted on each of said zones individually, and secondly making it possible to avoid substantially any sliding of the ring 10 on the body 21, said ring being clamped against said body at two distinct locations.

The ring 10 also includes an outer portion 15, preferably its radially-outermost portion, that includes a rigid axial wall portion that is capable of deforming plastically while the capsule 50 is being crimped. In particular, the purpose of the deformable wall 15 is to compensate for and to absorb, in part, any radial stress that is exerted thereon by the reservoir 1 at the moment when the fastener capsule 50 is being crimped on, the reservoir deforming radially inwards. As a result of the ring 10 including such a deformable wall portion, deformation of the reservoir 1 is not transmitted in full to the inner edge 11 of said ring, and consequently is not transmitted in full to the valve body 21. Any risk of the valve body 21 deforming, that would in turn risk causing the valve to jam or malfunction, is thus limited.

In the invention, the ring 10 eliminates any contact between the neck gasket 40 and the fluid contained in the reservoir 1. More particularly, during crimping, the portion of the reservoir that is deformed against the outer wall 15 of the ring, actively interferes with the wall, deforming it elastically and exerting radial pressure thereon, thereby creating peripheral sealing, preventing any contact between the fluid and the neck gasket 40. For example, the portion of the reservoir that is deformed causes the outer wall 15 of the ring to creep, this permanent deformation of the material creating total sealing. Preferably, the dimensions of the ring 10 are selected such that sealing is achieved only after crimping, and not while putting the ring 10 into place around the valve body 21. This makes it easier to insert the valve 20 provided with its ring 10 into the reservoir 1, avoiding excessive friction between the ring and the reservoir that could move the ring axially on the valve body. It is only while the capsule 50 is being crimped that the reservoir 1 deforms the ring 10 plastically, so as to create peripheral sealing.

In the invention, the ring 10 is made as a single piece that is substantially rigid and that is advantageously made of nylon. Preferably, the outer surface of the deformable wall 15 of the ring is plane and smooth, preferably mirror-polished, and in particular does not have any surface coating or modification that would make the ring more complex and thus more costly to make. The smooth surface also favors assembly, in particular the insertion of the valve into the reservoir. Even in the event of light contact between the ring and the reservoir during said insertion, the smooth outer surface slides against said reservoir without any risk of moving the ring axially over the valve body.

Figure 2:
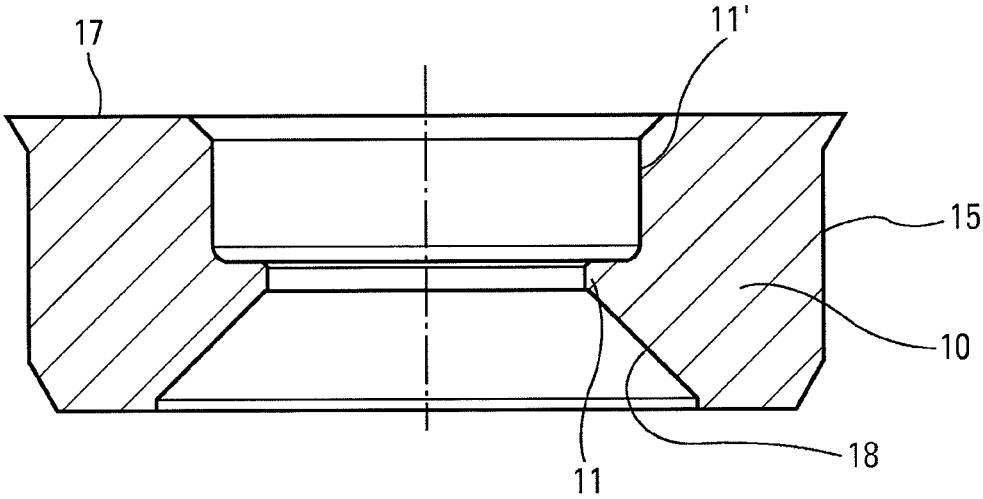
FIG. 2 is a larger-scale view of a detail of a portion of the FIG. 1 device.

With reference more particularly to FIGS. 1 and 2, the ring 10 advantageously includes a top surface 17 that is in contact with a major fraction of the bottom surface of the neck gasket 40. In addition, the ring 10 advantageously includes two contact points 11, 11' with the valve body, the surface areas of the contact points being small so as to simplify and facilitate assembly of the ring 10. Advantageously, a conical surface 18 is provided so as to guide the fluid towards the opening(s) 22 of the valve body.

Figure 3:
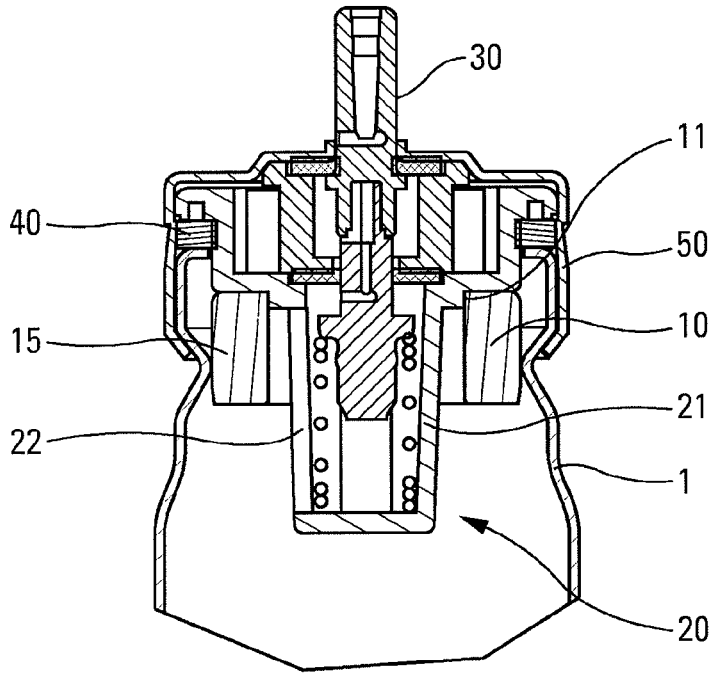
FIG. 3 is a diagrammatic section view of another embodiment of the invention.
Figure 4:
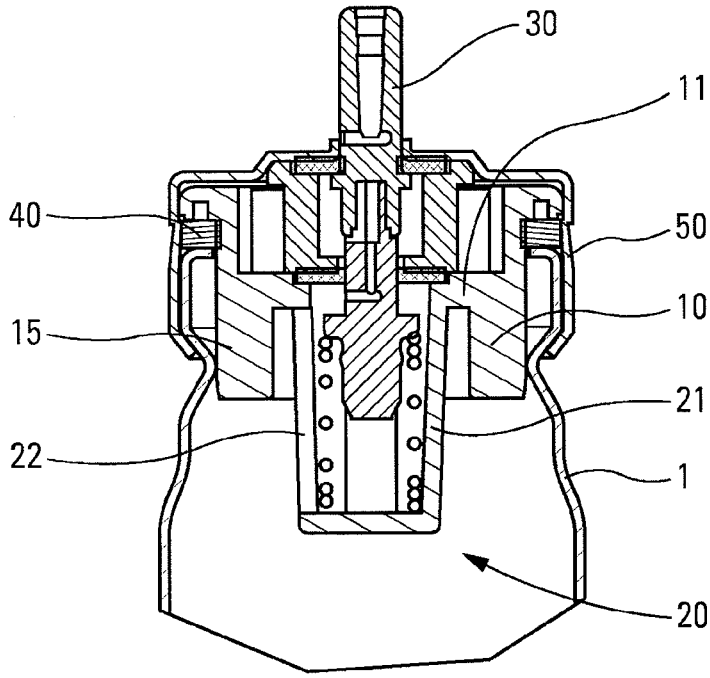
FIG. 4 is a view similar to the view in FIG. 3, showing yet another embodiment of the present invention.

FIGS. 3 and 4 show other embodiments of the invention.

In FIG. 3, the ring 10 is not in contact with the neck gasket 40 that is fastened directly between the valve body 21 and the reservoir 1. In the invention, the ring 10 is in peripheral leaktight contact with the reservoir 1 at its outer portion 15, after the capsule 50 has been crimped on. Preferably, the ring of this variant includes only one contact point 11 with the valve body 21, which contact point can be provided at a radial shoulder of said valve body. The advantage of this variant is that the ring has a very simple shape and is therefore easy and inexpensive to make.

In FIG. 4, the ring 10 is made integrally with the valve body 21, the inner portion 11 of the ring forming a connection piece. This configuration simplifies assembly of the valve, since it eliminates the step of assembling the ring on the valve body.

Although the present invention is described above with reference to several variant embodiments thereof, as shown in the drawings, the invention is naturally not limited to those variants, but, on the contrary, any useful modifications could be applied thereto by the person skilled in the art. In particular, the valve could be of any structure. In addition, the shapes of the valve body and of the openings could be different from the shapes shown. The same applies for the reservoir, and in particular to its neck. In general, any modification is possible without going beyond the ambit of the present invention as defined by the accompanying claims.

The invention claimed is:

1. A fluid dispenser device comprising: a reservoir (1) containing fluid to be dispensed; a fluid dispenser valve (20) including a valve body (21), said valve (20) being mounted on said reservoir (1) by a fastener element (50); and a ring (10) disposed around said valve body (21), said ring (10) comprising at least an outer portion (15) and an inner portion (11, 11') that co-operates with said valve body (21), said ring is made as a single piece, said outer portion (15) being adapted to co-operate in leaktight manner, by plastic deformation of the ring, with a portion of the reservoir (1) while the fastener element (50) is being assembled on the reservoir (1), wherein said outer portion forms a smooth surface before the fastener element is assembled on the reservoir.

2. A device according to claim 1, wherein said ring is dimensioned such that said ring co-operates in leaktight manner with the reservoir only after the fastener element (50) has been assembled on the reservoir (1).

3. A device according to claim 1, wherein said at least one inner portion (11, 11') presents a small contact surface with the valve body (21).

4. A device according to claim 1, wherein said ring (10) includes a radially-inner portion (11) that co-operates with a portion of the valve body (21), and a second inner portion (11') that co-operates with another portion of the valve body (21).

5. A device according to claim 1, wherein the ring (10) includes only a single inner portion (11) in contact with the valve body (21).

6. A device according to claim 1, wherein a top surface (17) of the ring (10) comes into contact with a neck gasket (40), and extends over a major fraction of a bottom surface of said neck gasket.

7. A device according to claim 1, further comprising a neck gasket and wherein said ring (10) makes no contact with the neck gasket.

8. A device according to claim 1, wherein said ring (10) is made integrally with said valve body (21) at an inner portion (11) of the ring that forms a connection piece.

9. A device according to claim 1, wherein, while the fastener element (50) is being assembled on the reservoir, said outer portion (15) creeps around a portion of the reservoir (1), creating total sealing at a location of the outer portion that creeps.

10. The device according to claim 1, wherein the fastener element is a crimpable capsule.

11. The device according to claim 1, wherein the smooth surface is mirror-polished.

12. A fluid dispenser device comprising:

a reservoir containing fluid to be dispensed;

a fluid dispenser valve including a valve body, the valve mounted on the reservoir by a crimped hoop; and a ring disposed around the valve body, the ring comprising at least an outer portion and an inner portion, the inner portion contacting the valve body, the ring is a single piece, the outer portion contacting in leaktight manner and under plastic deformation with a portion of the reservoir, and the outer portion, before the crimped hoop is assembled on the reservoir, has a smooth surface where the outer portion engages through sliding contact with the reservoir during assembly.

* * * * *